US010104955B2

(12) United States Patent
Keller

(10) Patent No.: US 10,104,955 B2
(45) Date of Patent: Oct. 23, 2018

(54) HEIGHT-ADJUSTABLE TABLE

(71) Applicant: Vitra Patente AG, Birsfelden (CH)

(72) Inventor: Stefan Keller, Steinen (DE)

(73) Assignee: VITRA PATENTE AG, Birsfelden (CH)

( * ) Notice: Subject to any disclaimer, the term of this patent is extended or adjusted under 35 U.S.C. 154(b) by 0 days.

(21) Appl. No.: 15/512,419

(22) PCT Filed: Oct. 1, 2015

(86) PCT No.: PCT/EP2015/072754
§ 371 (c)(1),
(2) Date: Mar. 17, 2017

(87) PCT Pub. No.: WO2016/050941
PCT Pub. Date: Apr. 7, 2016

(65) Prior Publication Data

US 2017/0360189 A1 Dec. 21, 2017

(30) Foreign Application Priority Data

Oct. 3, 2014 (EP) ..... 14187637

(51) Int. Cl.
*A47B 9/12* (2006.01)
*A47B 3/00* (2006.01)
*A47B 13/08* (2006.01)

(52) U.S. Cl.
CPC ..... *A47B 9/12* (2013.01); *A47B 3/002* (2013.01); *A47B 13/081* (2013.01)

(58) Field of Classification Search
CPC .... A47B 9/00; A47B 9/02; A47B 9/12; A47B 3/002; A47B 2003/0806; A47B 2003/0821; A47B 13/081; A47B 21/02; B65G 1/07
See application file for complete search history.

(56) References Cited

U.S. PATENT DOCUMENTS 2,240,395 A * 4/1941 Evans ..... A47B 13/081 108/130
3,339,795 A * 9/1967 Cappel ..... A47B 1/06 312/306

(Continued)

FOREIGN PATENT DOCUMENTS

DE 202009004806 10/2010
FR 2007844 A1 * 1/1970 ..... A47B 1/04
FR 2 243 143 4/1975

OTHER PUBLICATIONS

International Search Report dated Oct. 21, 2015 in PCT/EP2015/072754.

*Primary Examiner* — Jose V Chen
(74) *Attorney, Agent, or Firm* — Medler Ferro Woodhouse & Mills PLLC

(57) ABSTRACT

In a table having a height-adjustable table top and supporting structures, the table top is secured on the supporting structures so that the supporting structures support the table top. The supporting structures are placeable on a floor. The table includes at least one band which connects the supporting structures and the table top to each other, so that the table top is supported by the supporting structures in that it hangs at the supporting structures with the aid of the band. The table permits a simple, convenient, quick and precise adjustment of the height of the table top according to the needs of the respective user of the table.

13 Claims, 9 Drawing Sheets

(56) References Cited

U.S. PATENT DOCUMENTS

| | | | | | |
|---|---|---|---|---|---|
| 3,436,092 | A * | 4/1969 | Udo | A47B 31/04 | 108/115 |
| 4,880,285 | A * | 11/1989 | Brinkers | B65G 1/07 | 108/147 |
| 5,273,352 | A * | 12/1993 | Saper | A47B 51/00 | 312/312 |
| 5,715,759 | A * | 2/1998 | Lee | A47B 9/12 | 108/147 |
| 9,723,919 | B1 * | 8/2017 | Randolph | A47B 21/02 | |
| 2005/0172869 | A1 * | 8/2005 | Schmidt | A47B 9/12 | 108/147 |
| 2014/0227067 | A1 * | 8/2014 | Stover | B65G 1/04 | 414/267 |
| 2017/0150811 | A1 * | 6/2017 | Keller | A47B 9/12 | |

* cited by examiner

HEIGHT-ADJUSTABLE TABLE

TECHNICAL FIELD

The present invention relates to a table according to the preamble of independent Claim 1.

Such tables having a height-adjustable table top and supporting structures placeable on a floor, the table top of which being mounted at the supporting structures, so that the supporting structures may support the table top and, for example, be used as work tables in office spaces. Such tables are suited, in particular, for workplaces for which both working in the standing and sitting positions should be easily enabled and/or in which users frequently switch tables.

BACKGROUND OF THE INVENTION

Nowadays, height-adjustable tables are, among other things, increasingly used in situations in which users are situated at the table for a relatively long period of time. For health reasons and for reasons of convenience, it is increasingly intended to enable that the users of the tables modify their position if they use the tables for a relatively long period of time. For this purpose, it has been proved to be particularly expedient to configure the tables so that the users may use the tables both sitting and standing.

A further purpose of height-adjustable tables is to enable that a plurality of users can use one table and that the table is still respectively adaptively adjusted to the respective user. For example, in work environments in which work stations are shared by multiple people, using height-adjustable tables enables to take the individual needs of the users into account. Moreover, it is increasingly desirable that, inter alia in such work environments but also for other uses, the tables can be simply removed in a space saving manner.

Such as is also true for other tables, height-adjustable tables have a horizontal table top and a plurality of, for example, lateral, quasi vertical supporting structures. The supporting structures may be, for example, table legs, stand consoles or similar structures, which support the table top. To enable a height-adjustability of the table top, nowadays supporting structures are frequently equipped with a mechanism which allows a vertical displacement of the table top. For this purpose, for example supporting structures having latching rails are known, the table top being connected via the rails to the supporting structures. For adjusting the height of the table top, the table top is moved along the rails and latched in a preferred place.

To enable a convenient, continuous height adjustment of the table tops, nowadays also hydraulic systems are used in the mechanics of the supporting structures. In this instance, the hydraulic system connects the table top to the corresponding supporting structure. For adjusting the height of the table top, the hydraulic system is activated, which moves the table top into the desired position. Supporting structures having hydraulic mechanisms are, however, typically relatively bulky and heavy. In particular in the case of tables which are to provide a flexible use, tables having such supporting structures do often not meet the demands for a simple and compact removability or transportability.

Moreover, height-adjustable tables of the type described previously are often also equipped by a motor actuating the mechanism for adjusting the height of the table top. Such motors are typically also relatively heavy and bulky. Moreover, these motors are typically operated by electrical power and respectively require a connection to a power supply. This further limits the flexibility for using the tables.

For this reason, the object of the present invention is to propose a table for which the height of its table top can be manually adjusted in a convenient and efficiently infinitely variable manner. Moreover, a further object of the present invention can be to enable that the table can be removed in an efficient and space-saving manner.

DESCRIPTION OF THE INVENTION

The object according to the present invention is achieved by a height-adjustable table, as it is defined in independent Claim 1. Advantageous variant embodiments of the table according to the present invention result from the dependent claims.

The essence of the present invention is as follows: A table includes a height-adjustable table top and supporting structures placeable on a floor. The table top is mounted at the supporting structures so that the supporting structures support the table top. Furthermore, the table includes at least one band connecting the supporting structures and the table top, so that the table top is supported by the supporting structures in that it hangs with the aid of a band at the supporting structures.

The term "band" can, in particular, refer to a textile fabric having a limited width and any length. Such bands frequently include relatively sturdy longitudinal selvages. Bands of such type are, for example, also used as belt straps for roller shutters, as safety belts in transportation or as tension belts in transportation. Within the context of the present invention, the term "band" may also include unwoven belts, for example, leather or plastic belts. "Band" may also refer to ropes or cords or the like.

The supporting structures may also be made from a fixed, stable material, for example, metal, wood or a solid plastic. They may have feet by which they be placed in a stable manner on the floor.

Within the context of the table top, the term "height-adjustable" may be understood that the height of the table top or the distance of the table top from the floor, on which the table stands, may be adjusted by a user of the table. In particular, the height of the table top can be adjusted, while the table top is horizontally aligned.

To adjust the height, the table may have a suitable control mechanism which can be easily operated by a user of the table. "Height-adjustable" is not to be understood in the sense that the table is at least partially disassembled and has to be reassembled to modify the height of the table top. For such a disassembly and reassembly not understood as height-adjustable in the sense of the present invention, tools are typically used and such a disassembly and reassembly frequently has to be carried out by a skilled person.

By hanging the table top via the at least one band between the supporting structures, it can be achieved that the table top is height-adjustable in an infinitely variable manner. In particular, an adjustment of the band length results in that the table top in relation to the supporting structures is lifted or lowered. This enables a simple, convenient, fast and precise adjustment of the height of the table top according to the needs of the respective user of the table.

Preferably, two supporting structures are situated respectively lateral of the table top, the band connecting the supporting structures and the table top in such a manner that the table top hangs between the two supporting structures.

The term "lateral" in relation to the table top can refer to side edges of the table top. In this instance, the table top, in particular, can have one front edge facing a user of the table, one rear edge facing away from the user of the table and two side edges connecting the front edge to the rear edge. For a rectangular table top or a table top similar to a rectangular shape, the side edges may correspond to the shorter sides of the rectangle and the front and rear edges may correspond to respectively one of the two longer sides of the rectangle. By hanging the table top between the supporting structures, the table top is able to hang in a relatively stable manner. An undesired swinging, for example, in the lateral direction, may be efficiently controlled or prevented in this way.

Preferably, the table top has a bottom side and a top side and the at least one band runs from one of the two supporting structures along the bottom side of the table top to the other supporting structure of the two support structures. The top side of the table top may define a work or utility surface of the table. By the at least one band crossing transversely under the table top from the one supporting structure to the other supporting structure, it can be achieved that relatively few bands have to be used for a stable hanging of the table top. Moreover, such a configuration enables a relatively simple adjustment of the height of the table top. For example, this can be achieved in that the length of the band is modified or adjusted in only one single place. Because the band runs underneath the complete table top, such an adjustment of the band length acts in a distributive manner on the complete width of the table top.

Preferably, the at least one band includes two bands. The use of two bands, in particular, crossing transversely underneath the table top from one supporting structure to the other supporting structure, enables that the table top can be balanced and adjusted. In so doing, a one-sided tilting or canting of the table top may be prevented. More than two bands may also be provided.

In this instance, the table top has preferably one front edge, two side edges and one rear edge, and the two bands are, in relation to the side edges of the table top, preferably mounted in an offset manner to each other at the supporting structures. Preferably, a first band of the two bands runs from a front area of one of the two side edges of the table top, which is located closer to the front edge of the table top, via the bottom side of the table top to a rear area of another side edge of the two side edges of the table top, which is located closer to the rear area of the table top, and a second band of the two bands runs from a rear area of one of the two side edges of the table top, which is located closer to the rear edge of the table top, via the bottom side of the table top to a front area of the other side edge of the two side edges of the table top, which is located closer to the front edge of the table top.

This positioning of the two bands may achieve that the two bands cross at the bottom side of the table top. In so doing, when adjusting the table height, for example by adjusting the length of the bands, the power distribution on the table top can be even and balanced. In addition to distributing the forces acting upon the table top over the width of the table top when adjusting the height, in this way a respective power distribution can also be achieved in the depth of the table top. This can enable an efficient, precise and clean adjustment of the height of the table top and also an efficient lifting of the weights situated on the table top.

Preferably, the table has deflection means situated at the bottom side of the table top, the at least one band being guided by the deflection means along the bottom side of the table top. With the aid of the deflection means, the at least one band can be guided along the bottom side of the table top in such a way that the table top is supported in a stable and even manner. For example, when using two bands, the bands can be guided in an offset manner to each other in a straight-line manner at the bottom side, be crossed using deflection means and be again guided away in a straight-line manner from the bottom side of the table top by further deflection means. The deflection means can have straight or curved guide flanks, alongside which the at least one band runs. Such guide flanks enable to efficiently guide and deflect the at least one band in any direction.

Preferably, the supporting structures are configured as side walls. Such side walls enable a relatively simple configuration of stable supporting structures. Moreover, such side walls can serve for separation or for privacy and sound proofing of a work station, for example in an open-plan office. The side walls, for example, may be made from wood or a plastic.

In this instance, the table preferably has a rear wall located between the side walls. Such a rear wall can surround and enclose the table top from three sides. At the same time, the supporting structures can be fixedly connected to each other. This can provide the table with increased stability. Moreover, the rear wall enables a further separation of the table from its surroundings. The rear wall also may be made from wood or a plastic and, in particular, from the same material as the side walls.

Preferably, the table includes a winding shaft, the at least one band running via the winding shaft so that it is windable onto the winding shaft. In particular, the winding shaft may be mounted at the bottom side of the table top. With the aid of the winding shaft, the length of the at least one band may be precisely adjusted in an efficient and infinitely variable manner. This length adaptation may simultaneously enable to precisely adjust the height of the table top in an infinitely variable manner.

In this instance, the table preferably has an actuating crank, by means of which the winding shaft is rotatable about its longitudinal axis. In particular, the actuating crank may be a hand crank which, for example, may be situated near the front edge of the table top at the bottom side of the table top. The actuating crank enables a simple manual or also motorized winding of the at least one band onto or from the winding shaft.

The actuating crank may also be removably configured, so that it is connected to the table for adjusting the height of the table top and is removed from the table after the height of the table top has been adjusted. In so doing, it may be prevented that the actuating crank presents a bothersome part at the table if it is not needed. So that the actuating crank is removable, it may be provided, for example, as a type of socket wrench, for example, having a square connector. The actuating crank may be connected via a transmission gearing to the winding shaft. In this way, it may be achieved that, on the one hand, the height of the table top can be adjusted with little physical effort; on the other hand, the winding shaft for this purpose may also have a rotary axis different from the winding shaft, enabling a comfortable crank movement to adjust the height of the table top.

Preferably, a guide rail is situated at at least one of the supporting structures and a guide element is situated at one of the corresponding side edges of the table top, the guide rail of the supporting structure acting together with the guide element of the table top. To achieve an even guidance, in particular a guide rail may be provided at two or a plurality of supporting structures and a guide element may be provided at the corresponding sides or edges of the table top. With the aid of the guide rail and the guide element, a straight-line vertical movement of the table top can be ensured when the height of the table top is adjusted. In so doing, the risk of canting or of stalling the vertical movement of the table top can be reduced.

Preferably, the table top is tiltable between a horizontal position and a vertical position about a transverse axis in relation to the two supporting structures. In this way, the table top may be configured in a fold-up manner; this may be desirable, in particular, to remove the table in a space-saving manner.

In this instance, the table top has preferably a plurality of pivot bearings assigned to respectively one of the supporting structures. In particular, two pivot bearings may be provided. Such pivot bearings enable a relatively simple and reliable configuration of the tiltable table top. If the table is simultaneously provided having guide rails and guide elements of the type described previously, the guide elements may be mounted on the pivot bearings. This results in that the transverse axis can be positioned in a stable manner between the two rails.

In this instance, the two supporting structures are preferably at least partially foldable if the table top is folded into the vertical position. Such foldable supporting structures enable that the table can be removed in a relatively space-saving manner.

In this instance, the supporting structures preferably have respectively one fixed section and a folding section foldably connected to the fixed section. Such a two-part configuration of the supporting structures enables also, in particular, that the supporting structures may be efficiently folded and, at the same time, always still ensure sufficient stability of the table construction if the supporting structures are configured as side walls.

Preferably, the folding sections of the supporting structures in this instance are each connected via a hinge joint to the fixed sections of the supporting structures. Such hinge joints enable a relatively simple and stable configuration of the supporting structures by a folding section and a fixed section, also in particular if the supporting structures are configured as side walls.

BRIEF DESCRIPTION OF THE DRAWINGS

Further advantageous embodiments of the present invention result from the subsequent description of exemplary embodiments with the aid of the schematic drawing. In particular, the table according to the present invention is subsequently described in greater detail in reference to the appended drawings on the basis of exemplary embodiments.

MODE(S) FOR CARRYING OUT THE INVENTION

Figure 1:
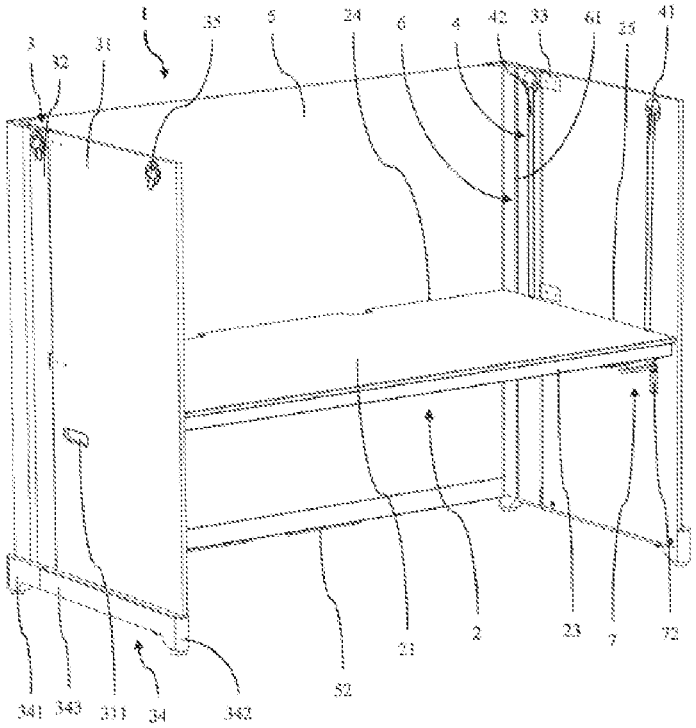
FIG. 1 shows a perspective view of a first exemplary embodiment of a table according to the present invention having a table top adjusted to a sitting height.

In the subsequent description, specific terms are used for practical reasons and are not to be understood in a restrictive manner. The words "right", "left", "down" and "up" reference directions in the drawing to which reference is made. The terms "inward", "outward", "rear" and "front" reference directions to or from the geometric center of the table and from designated parts of the table. The terminology includes the words explicitly mentioned above, derivative words of those words and words of similar meaning.

FIG. 1 shows a first exemplary embodiment of a height-adjustable and foldable table 1 according to the present invention. Table 1 includes a table top 2, two vertical side walls 3 as supporting structures and a vertical rear wall 5 connecting side walls 3. Table top 2 has a substantially rectangular top side 21, a rear edge 24 facing rear wall 5, a front edge 23 opposite rear edge 24 and two side edges 25 respectively connecting rear edge 24 to front edge 23. Side edges 25 form the short sides of rectangular top side 21 of table top 2 and front edge 23 or rear edge 24 form the long sides of the top side of the table top. Two recesses are inserted in rear edge 24, through which, for example, cables or the like may be pulled when using table 1.

Side walls 3 include respectively one fixed section 32 fixedly connected at a right angle to rear wall 5 and one folding section 31 foldably connected via respectively two hinges 33 to corresponding fixed section 32. Respectively one horizontal slot handle 311 is inserted in folding sections 31. At their bottom end, side walls 3 have respectively one foot part 34 having a rear foot 341, a front foot 342 and a connecting beam 343 connecting rear foot 341 to front foot 342. In this instance, rear feet 341 are situated adjacent to rear wall 5 and front feet 342 are situated at an end of folding section 31 facing away from the rear wall. If used according to specifications, table 1 is placed on the floor by rear feet 341 and front feet 342.

Rear wall 5 has at its lower end two side wall attachment arms 52. At the insides of fixed sections 32 of side walls 3, respectively one guide rail 61 is assigned to a table top guide 6. Guide rails 61 extend respectively vertically over the total height of corresponding fixed section 32. Furthermore, an actuating crank 7 mounted at table top 2, having a handle 72 vertically extending in the downward direction, can be seen in FIG. 1.

Table top 2 is attached with the aid of two bands 4 at side walls 3. For this purpose, a first band 41 near an upper edge of right side wall 3 and at a distance from rear wall 5 is installed at right rear wall 3. A second band 42 near an upper edge of right side wall 3 and near rear wall 5 is mounted at right side wall 3. Bands 4 run under table top 2 and are, in an analogous manner, again fastened at left side wall 3.

For attaching bands 4, side walls 3 have near their upper edges respectively two band attachments 35. Band attachments 35 include respectively one rotatably mounted disk having a slot and a clamping device at the outside. With the aid of band attachments 35, bands 4 are attached at the side walls in that they are guided through the slots of the disks and are clamped with the aid of the clamping device on the outside of side walls 3. For this purpose, first band 41 is attached at folding section 31 of right side wall 3 and runs along this folding section vertically downward to table top 2. Analogously, second band 42 is attached at fixed section 32 of right side wall 3 and runs along this fixed section also vertically downward to table top 2.

In FIG. 1, table top 2 is adjusted to a sitting height and is horizontally aligned, that is, is depicted having a horizontal top side 21 or positioned in an untilted manner. In so doing, the table top hangs between side walls 3 at bands 4. Side walls 3 and rear wall 5 surround and enclose table top 2. This lends table top 2 stability and prevents an undesired swinging or wobbling. Side walls 3 and rear wall 5 project over table top 2 in the vertical direction, that is, in the upward direction. In so doing, top side 21 of table top 2 and, in particular, a work space formed by the table top may be separated or protected from looks and noise.

The following statement applies to the entire further description: If reference characters are included in a figure for the purpose of graphic clarity, however, are not mentioned in the immediately corresponding description text, reference to their explanation is made in previous figure descriptions. Moreover, if reference characters not included in the corresponding figure are mentioned in a description text directly belonging to a figure, reference is made to the preceding or following figures.

Figure 2:
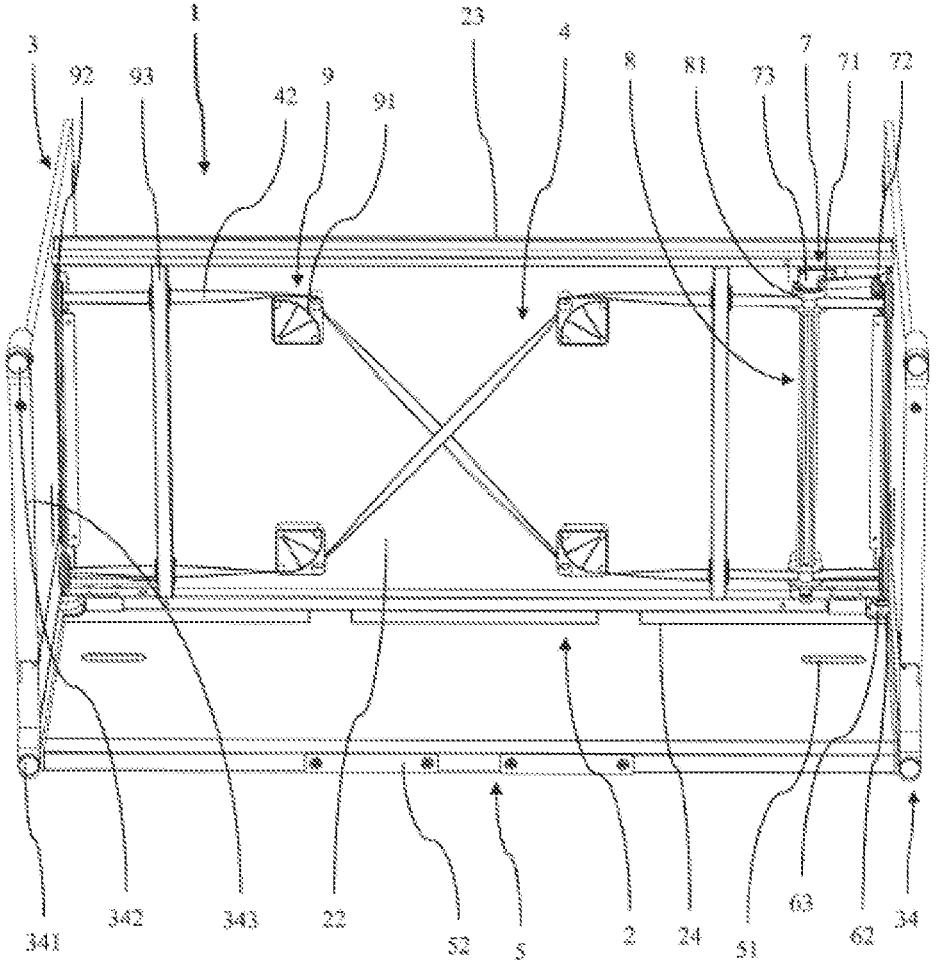
FIG. 2 shows a perspective view from below onto the table from FIG. 1.

In FIG. 2, table 1 is shown from below. In this instance, it can be seen that table top 2 has a bottom side 22 at which actuating crank 7, a winding shaft 8 and a band guide 9 as deflection means are mounted. Band guide 9 includes respectively two intake guides 92 on both sides adjacent to the side walls, two transition beams 93 extending across bottom side 22 of table top 2, having respectively two passages, and four deflection elements 91 positioned between transition beams 93. Between right transition beam 93 and the right end of table top 2, winding shaft 8 about its longitudinal axis is rotatably attached transverse to bottom side 22 of table top 2. Winding shaft 8 has two band winders 81 assigned to respectively one of two right intake guides 92.

As follows, the two bands run underneath table top 2 along its bottom side 22: First band 41 is guided on the right side from intake guide 92 positioned closer to front edge 23 of table top 2 to bottom side 22 of table top 2. From there, the band runs parallel to front edge 23 via one of band winders 81 of winding shaft 8 and to the left through one of the two passages of right transition beam 93. Past transition beam 93, first band 41 is redirected diagonally backwards by one of four deflection elements 91 in the direction of rear edge 24, where it meets a further deflection element of four deflection elements 91. From the deflection element, the band is then again redirected so that it runs parallel to rear edge 24 through the rear passage of the two passages of left transition beam 93 to the left to intake guide 92 positioned closer to rear edge 23. From this intake guide 92, the band runs along left side wall 3 upwards, where it is attached at fixed section 32 of left side wall 3.

In a complementary manner to first band 41, second band 42 runs along bottom side 22 of table top 2. Second band 42 is guided on the right side from intake guide 92 positioned closer to rear edge 24 to bottom side 22 of table top 2. From there, the band runs parallel to rear edge 24 via the other band winder of band winders 81 of winding shaft 8 and to the left through the other passage of the two passages of right transition beam 93. Past transition beam 93, second band 42 is redirected diagonally forward by a further deflection element of four deflection elements 91 in the direction of front edge 23, where it meets a last deflection element of four deflection elements 91. From the deflection element, the band is again redirected so that it runs parallel to front edge 23 through the front passage of the two passages of left transition beam 93 to the left to intake guide 92 positioned closer to front edge 23. From this intake guide 92, the band runs along left side wall 3 upwards, where it is attached at folding section 31 of left side wall 3. First band 41 and second band 42 cross each other between four deflection elements 91.

Actuating crank 7 includes a transmission gearing 73 fixedly mounted at bottom side 22 of table top 2. Handle 71 is together with an arm connected via a square connector 72 to transmission gearing 73. The handle also may be pulled off from transmission gearing 73 and be removed from table top 2. Transmission gearing 73 is connected to winding shaft 8 in such a manner that a rotary movement of handle 72 rotates winding shaft 8 about its longitudinal axis. In so doing, bands 4 are wound onto band winder 81 of winding shaft 8 or wound off the band winder. Accordingly, the length of bands 4 is indefinitely variably modified between band attachments 35 of side walls 3 and the height of table top 2 is indefinitely variably adapted or adjusted. For example, the length of bands 4 is shortened between band attachments 35 of side walls 3 by winding bands 4 onto winding shaft 8 so that table top 2 is lifted upward. By guiding bands 4 in a crossed manner along bottom side 22 of table top 2, the forces are relatively evenly distributed, so that a clean vertical movement of table top 2 free of tilting and canting is possible.

Moreover, the vertical movement of table top 2 is guided by table top guide 6. The table top guide includes engaging projections 62 and wheels 63 situated near rear edge 24 extending left and right at the sides. Engaging projections 62 engage into guide rails 61 and prevent a movement of table top 2 in the direction of rear wall 5 or away from rear wall 5. Wheels 63 project over table top 2 slightly to the left and to the right. During a vertical movement of the table top, the wheels roll along respectively corresponding side wall 3. In so doing, they ensure that table top 2 is at a slight distance from side walls 3, so that during a vertical movement of table top 2 relatively few friction forces result between table top 2 and side walls 3.

As can also be seen from FIG. 2, side wall attachment arms 52 of rear wall 3 are configured as flat rods, which may be flushly situated along the bottom edge of rear wall 5. Approximately halfway up the left and right edge, respectively one horizontal slot handle 51 is inserted in rear wall 5.

Figure 3:
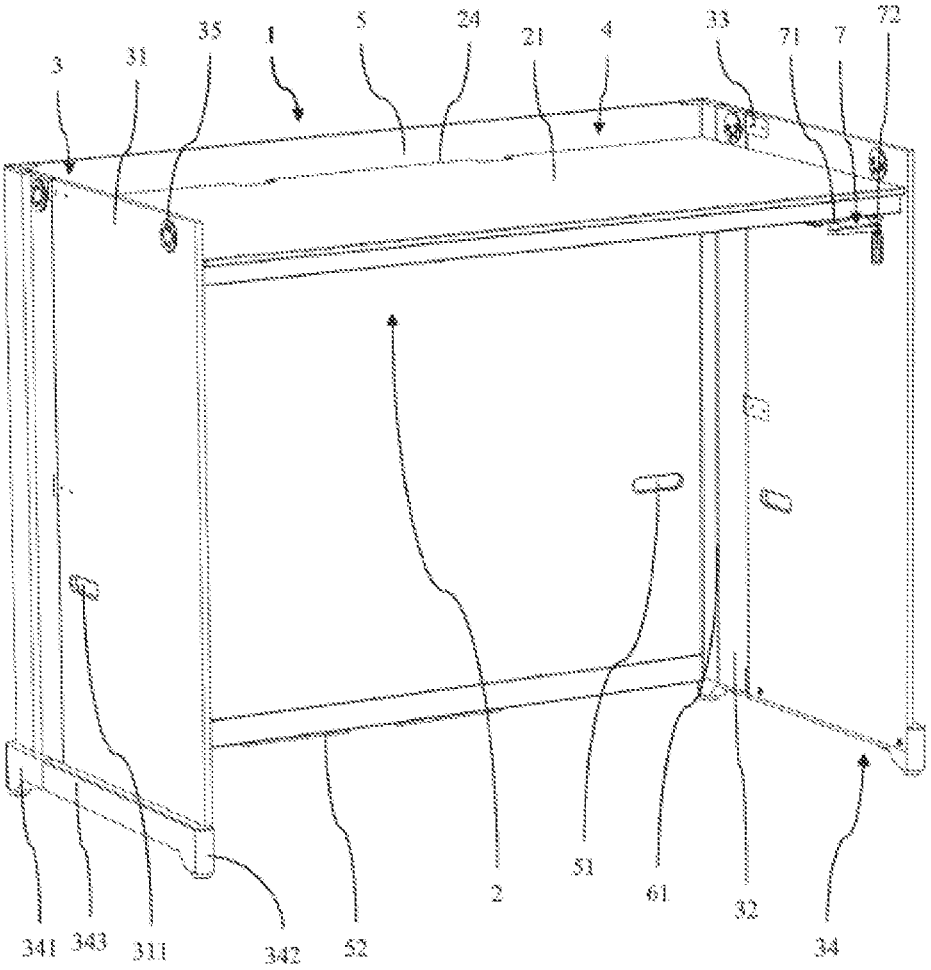
FIG. 3 shows a perspective view of the table from FIG. 1 having the table top adjusted to a standing height.

FIG. 3 shows table 1 in a position in which table top 2 is situated at the very top. This, for example, may be a standing position of table 1, in which a user may work standing at table 1. In this instance, bands 4 (not shown in FIG. 3) are wound up onto winding shaft 8 with the aid of actuating crank 7. The effective length of bands 4 between band attachments 35 of two side walls 3 is relatively small so that table top 2 is situated at the top.

As can also be seen from FIG. 3, slot handles 51 of rear wall 5 and slot handles 311 of side walls 3 are configured in a corresponding manner with one another. The slot handles are inserted at the same height.

Figure 4:
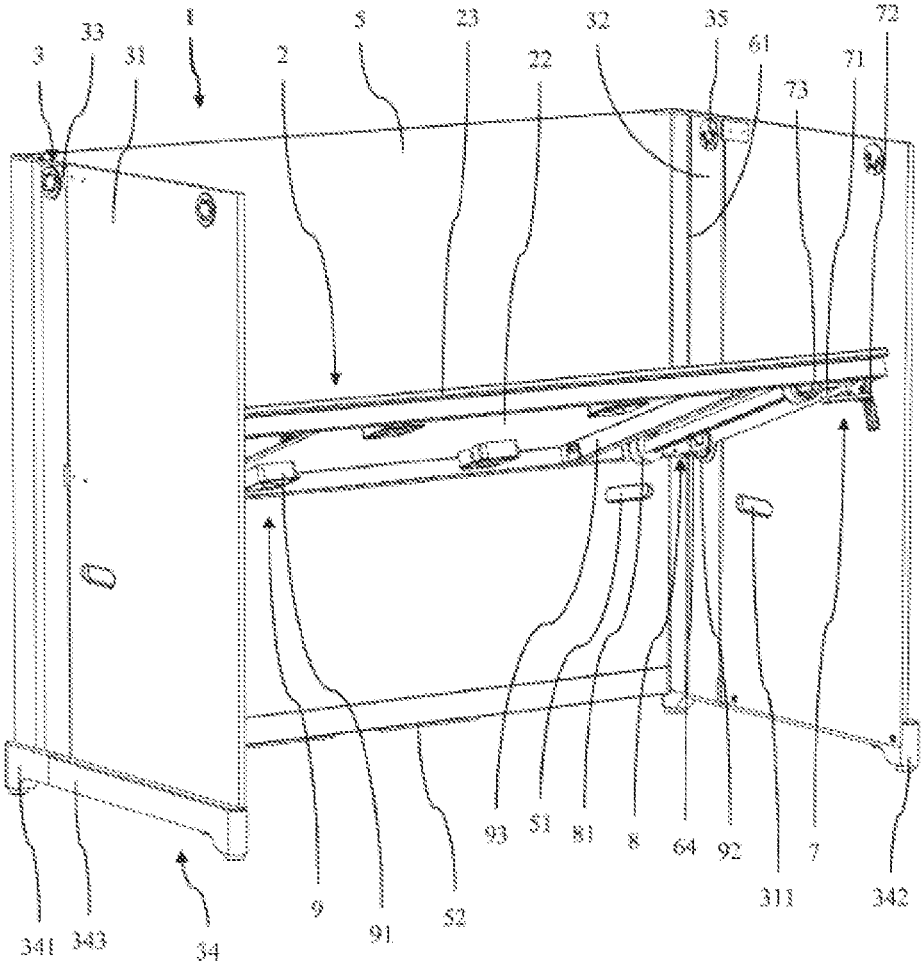
FIG. 4 shows a perspective view of the table from FIG. 1 during a tilt of its table top, the bands not being illustrated.

In FIG. 4, table 1 is shown while table top 2 is folded up for removing or transporting table 1. For this purpose, table top 2 is lifted at its front edge 23 and is tilted or rotated about pivot bearing 64 installed at table top 2 near its rear edge 24. Using bands 4 (not shown in FIG. 4) enables that said folding-up of table top 2 can go unhindered.

Figure 5:
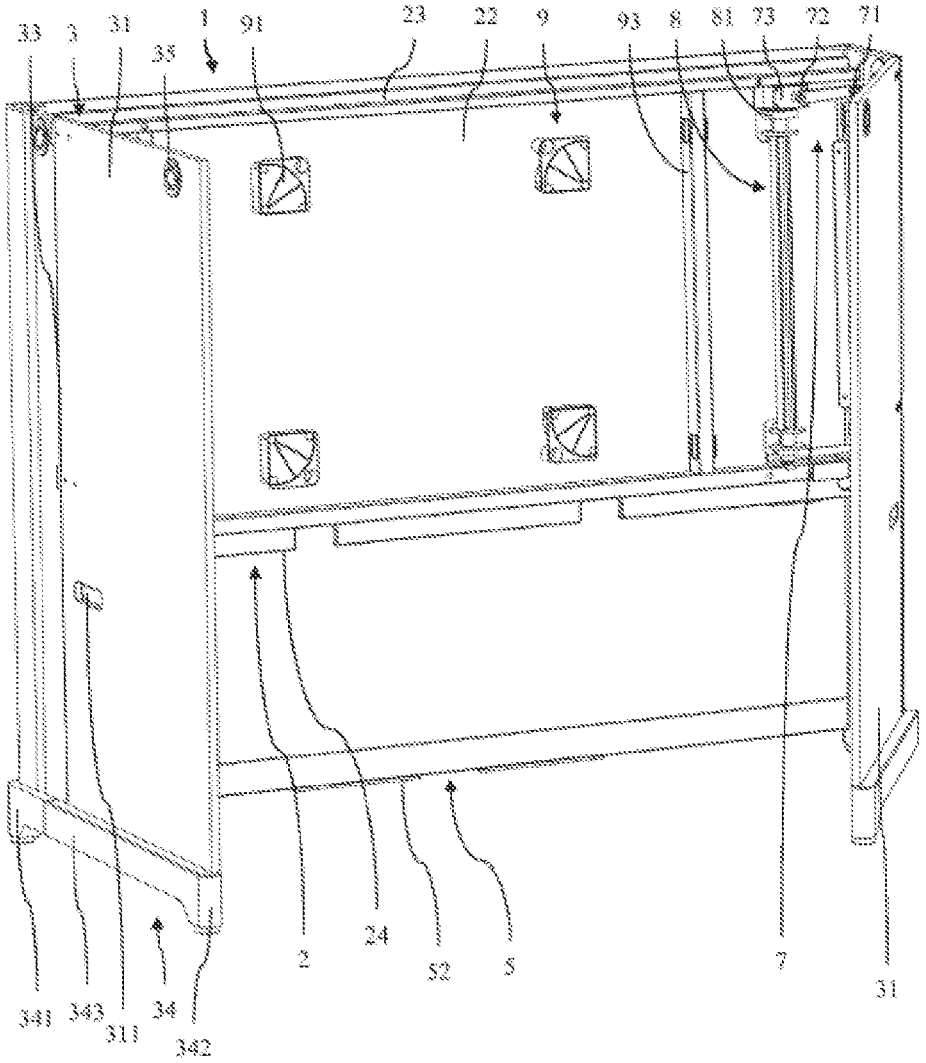
FIG. 5 shows a perspective view of the table from FIG. 1 having a completely tilted table top, the bands not being illustrated.

FIG. 5 shows table 1 having table top 2 completely folded-up. Table top 2 is in this position vertically aligned. As indicated at right side wall 3, when table top 2 is folded-up, folding sections 31 of side walls 3 may be folded inward with the aid of hinges 33.

Figure 6:
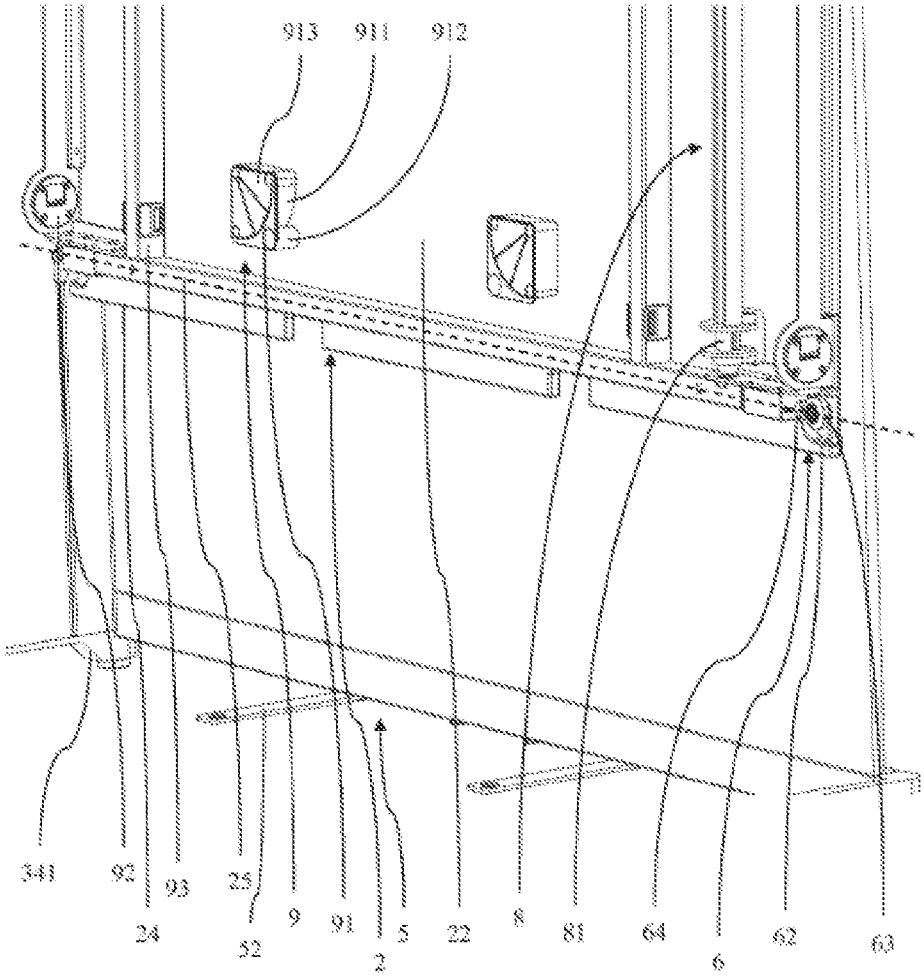
FIG. 6 shows a perspective detailed view of some components of the table from FIG. 1 having a completely tilted table top, the bands not being illustrated.

In FIG. 6, specific parts of some components of table 1 are shown in detail. Two pivot bearings 64 configured left and right at the table top define a cross axis 25 of table top 2, about which table top 2 is foldable or swivelable. In so doing, pivot bearings 62 are respectively formed by a rotary pin situated in an opening of a cross frame of table top 2. The rotary pins are each stationarily connected to one of wheels 63 and via a curved section to one of engaging projections 62.

Intake guides 92 have respectively one rotatably mounted, circular disk having a slot-shaped passage. In the final stage, bands 4 (not shown in FIG. 6) are pulled through the passages of the disk, so that intake guides 62 guide bands 4. By rotatably mounting the disks, it can be achieved that bands 4 are aligned also during folding up of table top 2, so that a twisting of the bands can be prevented.

Band attachments 81 of the winding shaft have respectively one cylindrical section bordered on both sides by a flange section. In the cylindrical section, a slot is inserted, through which corresponding band 4 is pulled. The flange sections prevent that, when winding up band 4, the band is axially displaced or wound up at a place not intended for winding up the band.

Deflections means 91 include respectively one quadrant-shaped guide flange 911, a fixing pin 912 and a square cover plate 913. Corresponding band 4 is situated along guide flange 911 and held by fixing pin 912 at the guide flange. In this instance, band 4 is deflected at a maximum by a quadrant. Cover plate 913 covers flange 911 and fixing pin 912 and prevents that band 4 slips.

Figure 7:
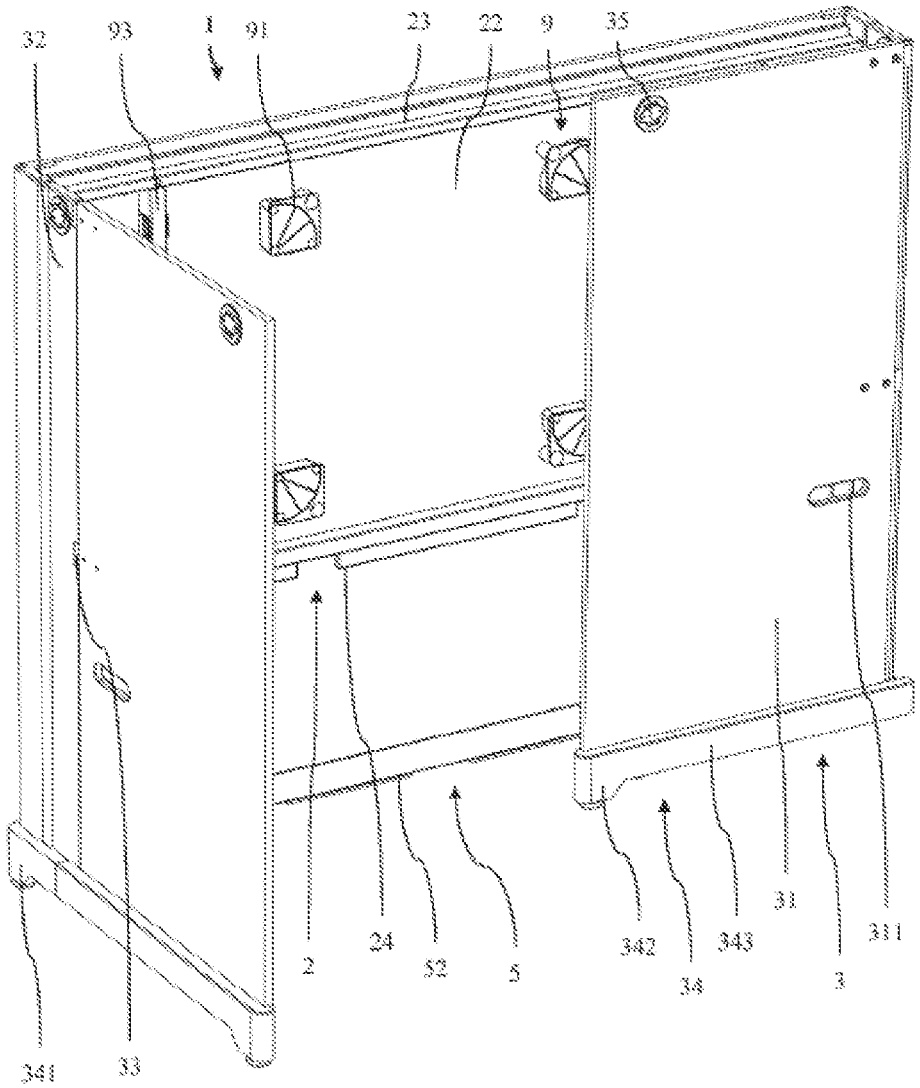
FIG. 7 shows a perspective view of the table from FIG. 1 having a completely tilted table top and one completely in-folded side wall, the bands not being illustrated.
Figure 8:
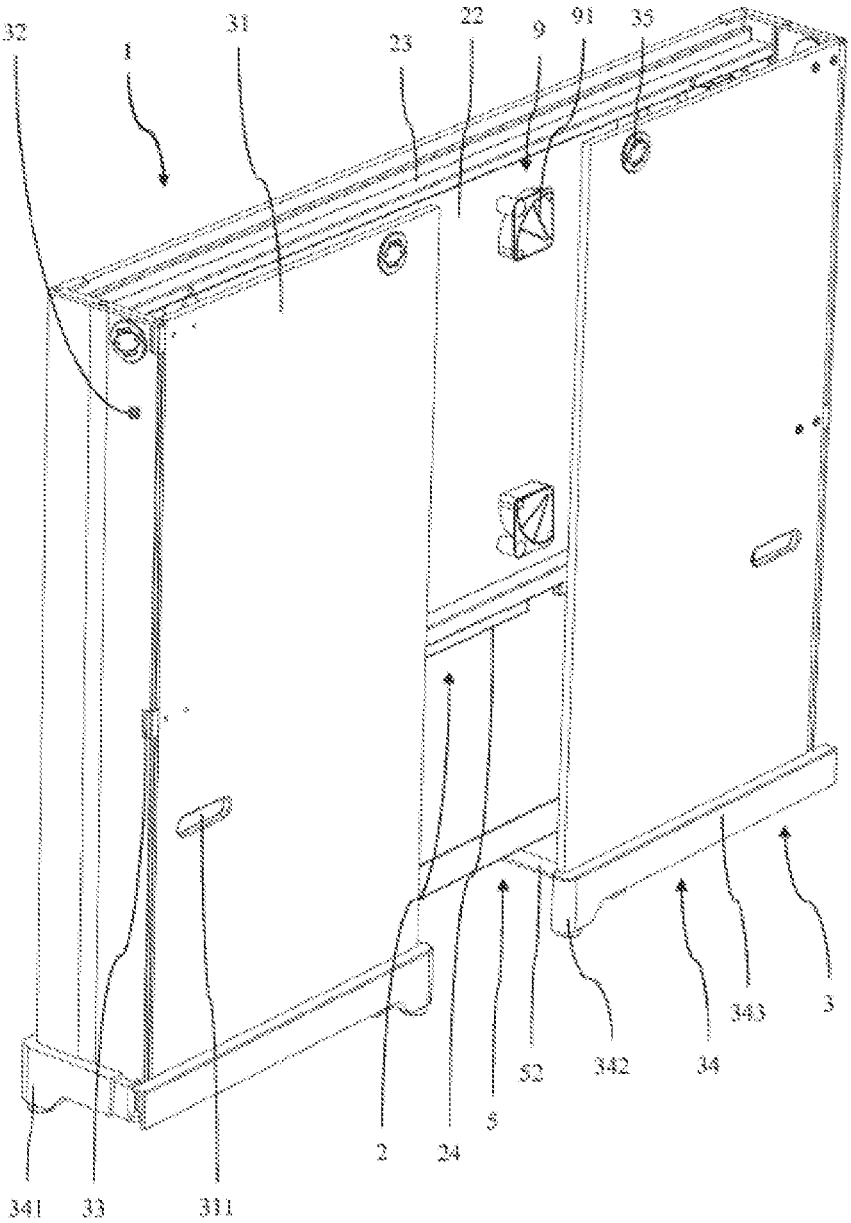
FIG. 8 shows a perspective view of the table from FIG. 1 having a completely tilted table top and both side walls completely in-folded, the bands not being illustrated.

FIG. 7 shows table 1 having table top 2 folded up and completely in-folded folding section 31 of right side wall 3. In this instance, in-folded folding section 31 is positioned parallel to rear wall 5. In FIG. 8, table 1 is shown having folding sections 31 of both side walls 3 folded in. Side wall attachments 52 of rear wall 5 are swiveled out so that they are positioned perpendicular to rear wall 5. They stop folding sections 31 of side walls 3 at rear wall 5.

In this position, table 1 forms a compact unit which may be efficiently stacked in a space-saving manner and efficiently transported. To fold up table top 2 and in-fold folding sections 31, no tools are necessary and it may be carried out by the user him/herself without a problem. Slot handles 311 of side walls 3 and slot handles 51 of rear wall 5 are positioned opposite each other so that one or two people can conveniently carry table 1 by these handles 311, 51.

Figure 9:
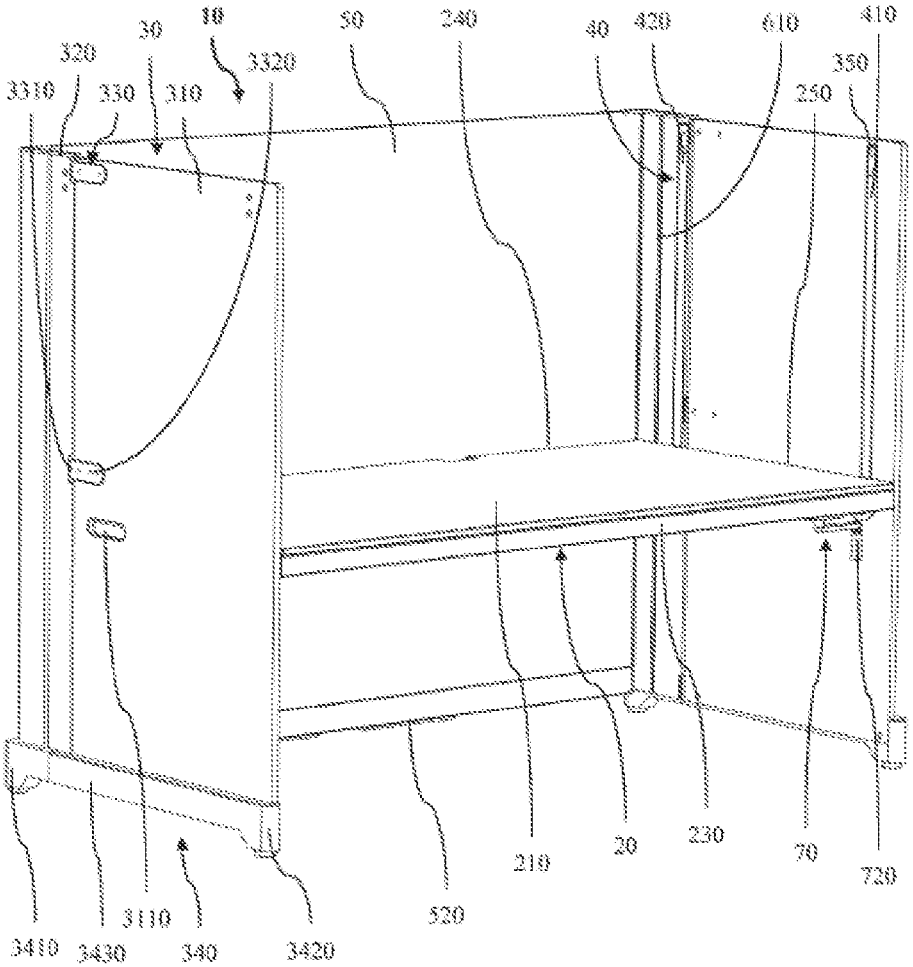
FIG. 9 shows a perspective view of a second exemplary embodiment of a table according to the present invention having a table top adjusted to a sitting height.

FIG. 9 shows a second exemplary embodiment of a table 10 according to the present invention. Table 10 is configured largely identical to table 1 from the previous figures. In particular, the table includes identical side wall 30 having slot handles 3110, folding sections 310, fixed sections 320 and rear feet 3410, front feet 3420 and connecting beams 3430 featuring foot parts 340, a rear wall 50 having side wall attachment arms 520, a table top 20 having a top side 210, a front edge 230, a rear edge 240 and side edges 250, a table top guide having guide rails 610, bands 40 having a first band 410 and a second band 420 and an actuating crank 70 having a handle 720.

Side walls 30 of table 10 have four band attachments 350. The band attachments are configured as clamp fittings, bands 40 being clamped or screwed between clamp fitting and interior side of side walls 310.

Moreover, side walls 310 include respectively two hinges 330 which have respectively one joint 3310 and an attachment plate 3320. In contrast to hinges 33 of table 1 shown in the previous figures, attachment plates 3320 are attached at the outsides of folding sections 310 of side walls 30.

Although the present invention is illustrated and described in detail with the aid of the figures and the corresponding descriptions, these illustrations and this detailed description are to be understood in an illustrative and exemplary manner and not to limit the present invention. It is understood that the skilled person also may make changes and modifications without departing from the scope of the subsequent claims.

The present disclosure also includes embodiments having any combination of features which are previously or subsequently mentioned or shown for different embodiments. The present disclosure also includes individual features in the figures, even if there they are shown within the context of other features and/or are not previously or subsequently mentioned. Alternative embodiments and individual alternatives of their features described in the figures and the description may also be excluded from the subject of the present invention or from the disclosed subjects. The disclosure includes embodiments which exclusively include the features described in the claims or in the exemplary embodiments as well as embodiments which include additional other features.

Furthermore, the term "include" and words derived thereof do not exclude other elements or steps. Also, the indirect article "a" and words derived therefrom do not exclude a plurality. The functions of a plurality of features stated in the claims may be fulfilled by a unit or a step. The terms "substantially", "about", "approximately" and the like in conjunction with a property or a value define, in particular, also exactly the property or exactly the value. The terms "about" and "approximately" within the context of a given numeral value or range may refer to a value or range, which lies within 20%, within 10%, within 5% or within 2% of the given value or range. All reference characters in the claims are not to be understood as limiting the scope of the claims.

What is claimed is:

1. A table having a height-adjustable table top and supporting structures, in which the table top is attached at the supporting structures so that the supporting structures support the table top, wherein the supporting structures are placeable on a floor, and wherein the table includes a first band and a second band connecting the supporting structures and the table top to each other, so that the supporting structures support the table top in that the table top hangs with the aid of the first and second bands at the supporting structures, wherein the table top has a front edge, a first side edge, a second side edge and a rear edge and wherein the first and second bands in relation to the first and second side edges of the table top are mounted in an offset manner to each other at different locations at the supporting structures, wherein the first band runs from a front area of the first side edge of the table top, which is located closer to the front edge of the table top, via a bottom side of the table top to a rear area of the second side edge of the table top, which is located closer to the rear edge of the table top, and the second band runs from a rear area of the first side edge of the table top, which is located closer to the rear edge of the table top, via the bottom side of the table top to a front area of the second side edge of the table top, which is located closer to the front edge of the table top.

2. The table as recited in claim 1, wherein the supporting structures include two supporting structures and the two supporting structures are situated respectively laterally of the table top, wherein the first and second bands connect the two supporting structures and the table top to each other in such a manner that the table top hangs between the two supporting structures.

3. The table as recited in claim 2, wherein the table top is tiltable about a cross axis in relation to the two supporting structures between a horizontal position and a vertical position.

4. The table as recited in claim 3, wherein the table top has a plurality of pivot bearings assigned to respectively one of the two supporting structures.

5. The table as recited in claim 3, wherein the two supporting structures are at least partially foldable when the table top is folded into the vertical position.

6. The table as recited in claim 5, wherein the two supporting structures have respectively one fixed section and a folding section foldably connected to the fixed section.

7. The table as recited in claim 2, wherein the first and second bands run from one of the two supporting structures along the bottom side of the table top to the other of the two supporting structures.

8. The table as recited in claim 7, which has at the bottom side of the table top situated a band guide, wherein the first and second bands are guided by the band guide along the bottom side of the table top.

9. The table as recited in claim 1, wherein the supporting structures are configured as side walls.

10. The table as recited in claim 9, further comprising a rear wall located between the side walls.

11. The table as recited in claim 1, further comprising a winding shaft, wherein the first and second bands run over the winding shaft, so that the first and second bands are windable onto the winding shaft.

12. The table as recited in claim 11, further comprising an actuating crank by which the winding shaft is rotatable about its longitudinal axis.

13. The table as recited in claim 1, wherein a guide rail is situated at at least one of the supporting structures and a guide element is situated at one of the first and second side edges of the table top, wherein the guide rail of the supporting structure acts together with the guide element of the table top.

* * * * *